US005642847A

United States Patent [19]

DeMeo et al.

[11] Patent Number: 5,642,847

[45] Date of Patent: Jul. 1, 1997

[54] FIREARM SUPPORT

[75] Inventors: Attilio Alexander DeMeo, Brooklyn; Joseph Corso, Staten Island, both of N.Y.

[73] Assignee: Rapid Draw Inc., Staten Island, N.Y.

[21] Appl. No.: 674,899

[22] Filed: Jul. 3, 1996

[51] Int. Cl.[6] ..... A45F 5/00; F41C 33/02

[52] U.S. Cl. ..... 224/623; 224/149; 224/150; 224/193

[58] Field of Search ..... 224/623, 624, 224/911, 913, 149, 150

[56] References Cited

U.S. PATENT DOCUMENTS

| | | | |
|---|---|---|---|
| 1,469,285 | 10/1923 | Thompson . | |
| 2,423,531 | 7/1947 | Theis | 224/2 |
| 2,873,902 | 2/1959 | Decker | 224/1 |
| 3,155,297 | 11/1964 | Stumpf | 224/913 |
| 3,501,074 | 3/1970 | Emerick | 224/913 |
| 3,819,094 | 6/1974 | Hyde | 224/1 R |
| 4,505,411 | 3/1985 | Munn | 224/913 |
| 4,911,345 | 3/1990 | James et al. | 224/149 |
| 5,325,618 | 7/1994 | Tuner | 42/85 |

*Primary Examiner*—Renee S. Luebke
*Assistant Examiner*—Timothy L. Maust
*Attorney, Agent, or Firm*—Goldstein & Associates

[57] ABSTRACT

An improved firearm support is disclosed, comprising a base assembly and a harness secured thereto which is worn by a user to secure said base assembly firmly adjacent to the user's chest. A plurality of support pins protrude outward from the base assembly for receiving and supporting a weapon thereupon. Typically, a weapon having a barrel area and a trigger guard is supported upon the support pins by resting the barrel area of the weapon upon a first support pin and resting the trigger guard of said weapon upon a second support pin. A detachable fastening strap extends from an edge of the base assembly, around the supported weapon, and engages the base assembly on the other side of said weapon, cinching the weapon against the base assembly and holding it firmly thereat, providing the user with hands-free support and permitting said user to move about in an unencumbered manner. Actuation of a trigger located upon the base assembly allows the user to silently disengage the fastening strap and bring the firearm to a ready-to-use position. A safety lock prevents accidental releases of the firearm from the support pins.

15 Claims, 4 Drawing Sheets

FIREARM SUPPORT

BACKGROUND OF THE INVENTION

The invention relates to an apparatus for securely yet detachably supporting a firearm adjacent to a user's chest. More particularly, the invention relates to an apparatus comprising a base assembly which is worn upon the chest of the user and secured thereat through the use of a harness. The base assembly has support pins and a fastening strap secured thereto for supporting and securing the firearm. By doming the harness and positioning the base assembly at a central region of the user's chest with the support pins pointing outward, the user is afforded free and unencumbered use of both hands, while the firearm is situated such that it is safely secured and supported in a ready-to-use position. In the event that the user wishes to enter an offensive posture and ready the firearm for near-instant use, a release trigger quickly disengages the fastening strap thus releasing the firearm from the base assembly.

Often, individuals possessing a firearm wish to do so in a secure manner without having to sacrifice the ability to have one's hands free to perform extraneous functions. This hands-free ability, however, must not be obtained at the expense of the ability to quickly ready the firearm for instant use. Accordingly, two important goals—securement of the firearm without forgoing hands-free convenience, and the ability to quickly ready the firearm for use—must be achieved in designing an effective firearm support. Attempts in the art to address these recognized concerns and achieve these goals, however, have proven ineffective.

Prior art attempts at solving these needs have tended to address one or the other concern, but never effectively address both. The common rifle shoulder strap employed by the military and law enforcement for many years provides a key example. This apparatus typically comprises no more than a shoulder strap which engages a firearm. The apparatus is employed by securing the firearm thereto and then slinging the firearm over the user's shoulder such that the firearm is loosely positioned before the user's midsection. While the firearm may be quickly readied for use, it is not effectively "secured" to the user's person sufficient to allow the user hands-free ability to engage in tasks unrelated to the use of the firearm. Since the firearm is merely draped over the user's shoulder via the shoulder strap, it is capable of swinging forward away from the user's chest in the event that the user is required to lean forward for something as simple as to pick up an object. Similarly, any quick turning motion by the user will result in the firearm swinging on an outward arc, possibly contacting a nearby person or object. In addition, the user is susceptible to being struck in the face by the firearm in the event that the user engages in any abrupt vertical movements.

In attempts to remedy this apparent lack of securement of the firearm, many users of this shoulder strap device choose to sling the firearm/strap assembly over the user's shoulder to the rear, such that the firearm is then positioned upon the user's back rather than his front midsection. While the employment of the device in this manner does indeed alleviate much of the potential for the firearm to swing about wildly and impede the user's movements, it unfortunately causes the firearm to be inaccessible in the event it is needed quickly, since the user must reach behind his back and draw the firearm over his shoulder.

Other apparatus found in the prior art, such as U.S. Pat. No. 3,819,094 to Hyde have similarly failed to adequately address the desired attributes mentioned above. The Hyde device essentially comprises a socket or cup like device with an open end extending upward, which is secured to the front groin area of a user by means of a waist strap. Said socket is sized to accept a scope of a rifle, such that a rifle having a scope mounted thereto may be supported by the socket. A leash worn about the neck of the user detachably engages the barrel of the firearm in an attempt to lend extra support and restraint of the firearm, in addition to the support provided by the socket. Properly mounted, the firearm is secured completely vertical, adjacent to the user's front. In order to ready the firearm for use, the barrel portion must be pushed away from the user's body with sufficiently vigorous force to disengage a clip which secures the barrel of the rifle to the leash which is looped around the user's neck. Once disengaged, the scope of the rifle is then lifted out of the waist-mounted socket/cup device and the rifle readied for use.

The inherent disadvantages of the Hyde device are numerous. Due to its construction, the device obviously is limited in use to accept only firearms having a scope mounted thereon. Also, because the leash which restrains the barrel of the firearm is dependent upon the neck of the user, there is great potential for injury to the user upon his forcing the firearm away from his body in order to disengage the neck leash from the barrel. Furthermore, the positioning of the firearm in a vertical line adjacent to the center of the front length of the user's body places the firearm directly in the user's line-of-sight, thus potentially distracting the user and obstructing his view. The location of the muzzle of the barrel directly in front of the user's face is likewise unsafe. Finally, the vertical mounting method hinders expeditious positioning of the firearm in the event that it becomes necessary to ready the firearm instantly. An ungainly process of disengaging the neck leash from the barrel, followed by lifting the scope of the firearm up and out of the socket/cup device and then bringing the firearm from a vertical orientation to a horizontal position must be performed to ready the firearm.

U.S. Pat. No. 5,325,618 to Turner comprises a first strap which encircles the user's upper chest area just below the arms. A shoulder strap, adjoining said first strap, extends perpendicular therefrom on either side of said first strap, and over the user's shoulder. A hook and loop fastening strip mounted to the shoulder strap retains a rifle's barrel thereat. A sleeve accepts the butt of the rifle, and is secured to the first strap/shoulder strap by a tether. The sleeve/tether assembly operates as the primary support for the rifle and lends additional support to the first strap, which serves merely to retain the barrel of the rifle in place against the user's shoulder.

Operation of the Turner device proves cumbersome and awkward. To ready the rifle for use, the user must first manually disengage the hook and loop fastening strips to release the firearm's barrel. Furthermore, the entire load of the firearm's weight is concentrated upon the tether. In the event that the tether proves incapable of supporting such weight and breaks, the firearm's unsupported barrel would slide out of the hook and loop fastening strip and the rifle would fall, butt first to the ground with the barrel aimed upward at the user's body. The concomitant danger is quite obvious. Finally, the sleeve/tether arrangement of this device prevents the user from ever fully shedding the firearm in the event that the user desires complete, unencumbered mobility.

Other devices, such as those disclosed by U.S. Pat. No. 2,423,531 to Theis and U.S. Pat. No. 2,873,902 to Decker are also found in the art. While all of these above mentioned units may be suitable for the particular purpose employed, or for general use, they would not be as suitable for the purposes of the present invention as disclosed hereafter.

SUMMARY OF THE INVENTION

It is an object of the invention to produce an improved firearm support which comprises a base assembly and a harness. By doming the harness, the user can position and secure the base assembly adjacent to the user's chest.

It is another object of the invention to produce an improved firearm support wherein the base assembly has first and second support pins for supporting the firearm adjacent to the base assembly, and hence immediately adjacent to the user's chest. The positioning of the firearm in a diagonal line centers the weight of the firearm at the user's midsection.

It is a further object of the invention to produce an improved firearm support with a fastening strap that secures the firearm to the base assembly. The fastening strap is adjustable accordingly to the type and style of the firearm being used. The fastening strap, in conjunction with the support pins, steadies the firearm against the base assembly and allows the user to move about in an unencumbered manner.

It is a still further object of the invention to produce an improved firearm support with a quick release feature which allows the user to silently disengage the fastening strap and immediately bring the firearm to a ready-to-use position. A safety lock prevents accidental disengagement of the fastening strap, and release of the firearm from the support pins.

It is a still further object of the invention to produce an improved firearm support that can be employed by military and law enforcement personnel. A sentinel on watch duty, for example, could easily don the apparatus and move about freely in a defined area, his firearm being ready the entire time. A hunter proceeding through a potential game area could also utilize the apparatus to enjoy hands-free mobility. In both scenarios, the user of the apparatus could quickly ready the firearm without alerting others, as a result of the silent release feature built into the release trigger of the device.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1:
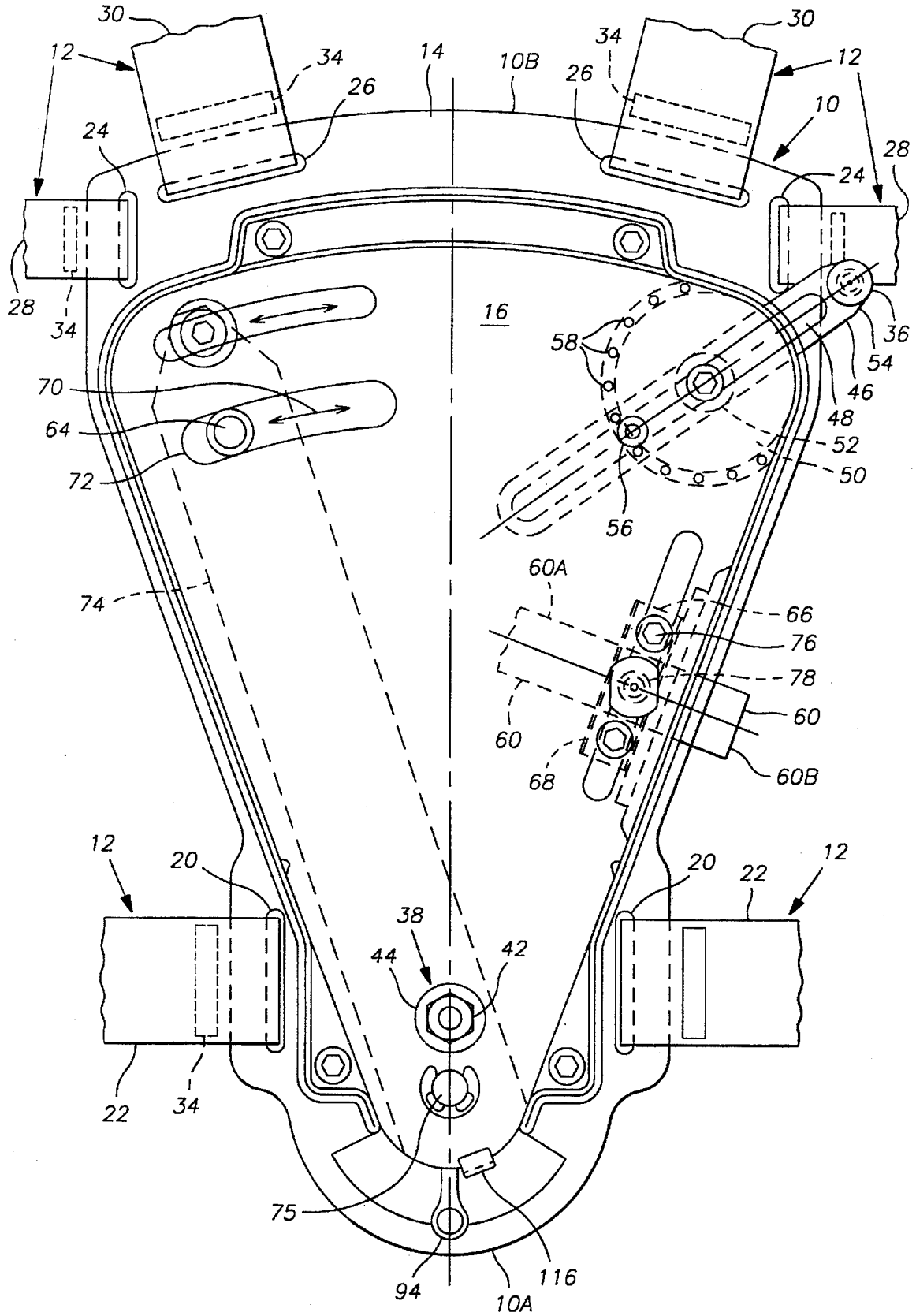
FIG. 1 is a detailed plan view of a preferred embodiment of the firearm support.
Figure 3B:
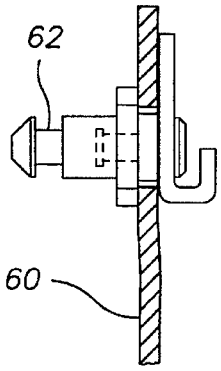
FIG. 3B is an enlarged view of a section of the instant invention, taken on line 3-B of FIG. 3A.
Figure 3A:
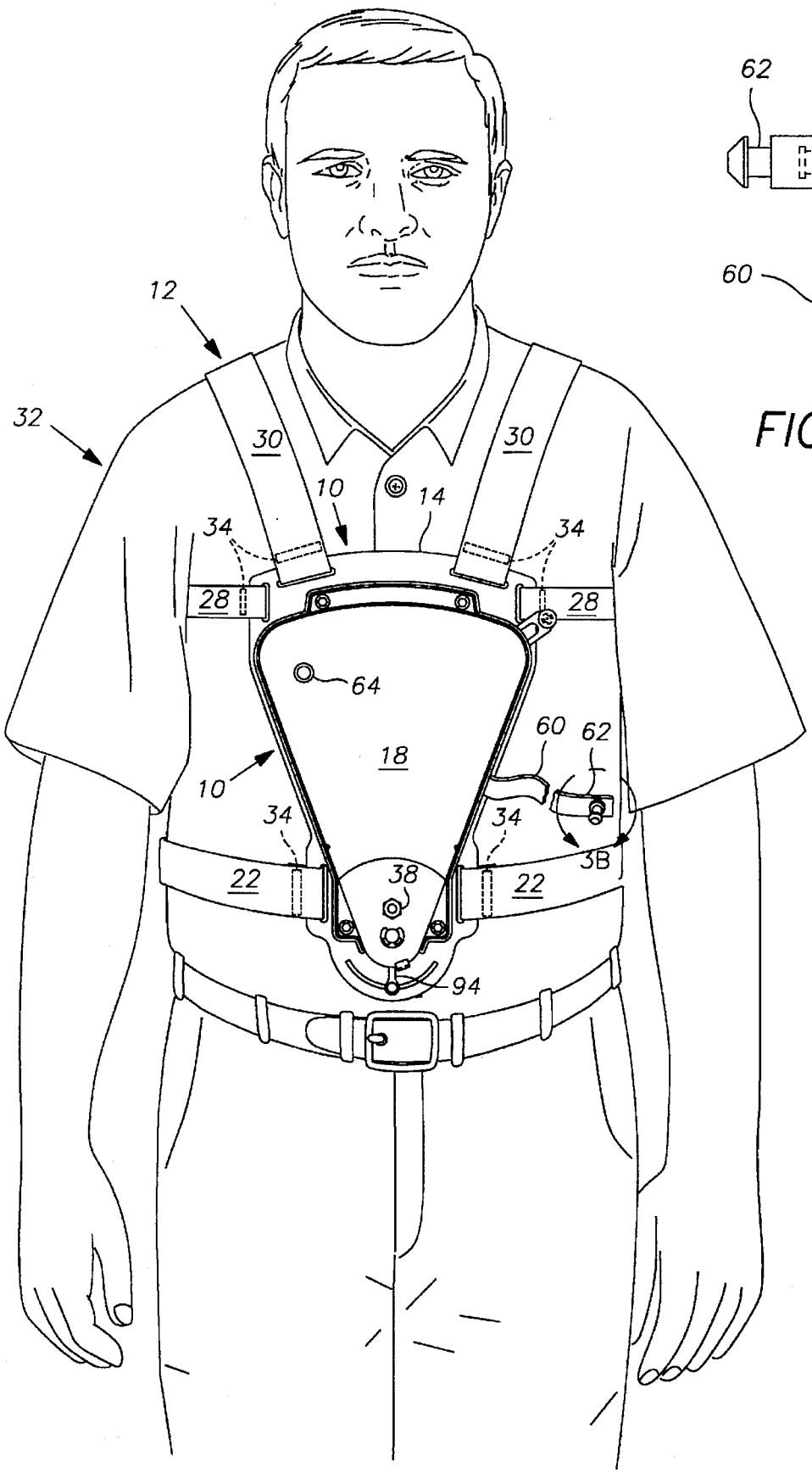
FIG. 3A depicts a user wearing the firearm support of FIG. 1 and illustrating its use.

FIG. 1 illustrates a firearm support comprising a base assembly 10 and a harness 12. The base assembly 10, essentially triangular in shape, comprises an apex end 10A and a base end 10B. The base assembly 10 further comprises a main plate 14, an intermediate plate 16 and a face plate 18. Said face plate 18 is not secured to the base assembly 10 in FIG. 1, but is depicted in FIG. 3A installed over the intermediate plate 16. Waist strap slots 20, located upon the main plate 14 at the apex end 10A of the base assembly 10, accept a pair of waist straps 22, as seen clearly in FIG. 1. Similarly, underarm strap slots 24 and shoulder strap slots 26 are located upon the main plate 14 at the base end 10B of the base assembly 10, and accept, respectively, underarm straps 28 and shoulder straps 30.

As seen in FIG. 3A, the waist straps 22, underarm straps 28 and shoulder straps 30 all diverge from the main plate 14 of the base assembly 10 towards the rear of a user 32, thus forming the fully assembled harness 12 which firmly supports the base assembly 10 upon said user 32. Strap connectors 34 are provided, said strap connectors 34 capable of engaging and disengaging the respective straps 22, 28 and 30 from the base assembly 10, as well as permitting adjustment of the length of each of said straps 22, 28 and 30 so as to yield ultimate comfort to the user 32.

Referring back to FIG. 1, support means, namely a first support pin 36 and a second support pin 38 are shown. In this particular embodiment of the instant invention, said first support pin 36 is depicted positioned at the base end 10B of the base assembly 10, while the second support pin 38 is shown located at the apex end 10A of the base assembly 10. It should be noted however, that the positioning of the support pins 36 and 38 need not be configured in this manner, and can follow any numerous number of possibilities capable of safely and adequately supporting a firearm 40 such as that shown in FIG. 4. Furthermore, the support means of the base assembly 10 can also comprise one or more stanchions, hooks, shelves, or ledges protruding therefrom, or any combination of these items.

The second support pin 38, as seen in FIG. 1, is secured to and extends upward from the intermediate plate 16 at the apex end 10A of the base assembly 10. The second support pin 38 comprises a bolt 42 which is secured to the surface of the intermediate plate 16, and a sleeve 44 which encircles the diameter and extends along the length of said bolt 42. The sleeve 44 acts to protect the firearm 40 supported thereby from damage which may result from sharp edges or surfaces of the bolt 42. Sleeves 44 of varying outside diameters may be utilized to accommodate a variety of firearms 40.

The first support pin 36, as also illustrated in FIG. 1, is located at the base end 10B of the base assembly 10, beyond the boundary of the main plate 14. An elongated slide member 46, having a groove 48 extending along its length at the center, extends through an adjustment disc 50 and is secured thereto by means of a slide bolt 52 which extends through the center of the adjustment disc 50 and then through the groove 48 of the elongated slide member 46. The adjustment disc 50 is sandwiched between the main plate 14 and intermediate plate 16 of the base assembly 10 and is rotatable therein. The first support pin 36 is secured to an outer end 54 of the elongated slide member 46. Similar to the second support pin 38 which may be encapsulated by a sleeve 44, so too may the first support pin 36 possess a sleeve 44 to protect the firearm 40 supported thereby from damage which may result from sharp edges or surfaces of the first support pin 36. The position of the elongated slide member 46, and hence the position of the first support pin 36 which is secured to the outer end 54 of said elongated slide member 46, may be adjusted by rotating the elongated slide member 46 about the slide bolt 52, subsequent to loosening a slide set screw 56. The presence of the adjustment disc 50 and elongated slide member 46 which protrudes therefrom allows maximum adjustment of the elongated slide member 46 while ensuring that no open spaces will exist around the adjustment area which might allow dirt or other foreign matter to enter the interior of the base assembly 10.

The slide set screw 56, fastened through the groove 48 which extends along the center of the elongated slide member 46, can be inserted into a number of predetermined slide position holes 58 which are disposed around the periphery of the adjustment disc S0 to firmly fix the elongated slide member 46 and the first support pin 36 in place and prevent further, unwanted rotation.

The position of the elongated slide member 46, and hence the position of the first support pin 36 which is secured to the outer end 54 of said elongated slide member 46, may be further adjusted by sliding the elongated slide member 46 in and out along the slide bolt 52 after loosening said slide bolt 52. The combination of possible positions available as a result of pivoting the elongated slide member 46 about the slide bolt 52, as well as varying the amount of the elongated slide member 46 which extends from the base assembly 10, permits an almost unlimited number of firearms 40 to be used in conjunction with the instant invention. Nevertheless, one or two generic position settings of the first support pin 36 will prove to accommodate almost every standard type of firearm 40 available.

Figure 4:
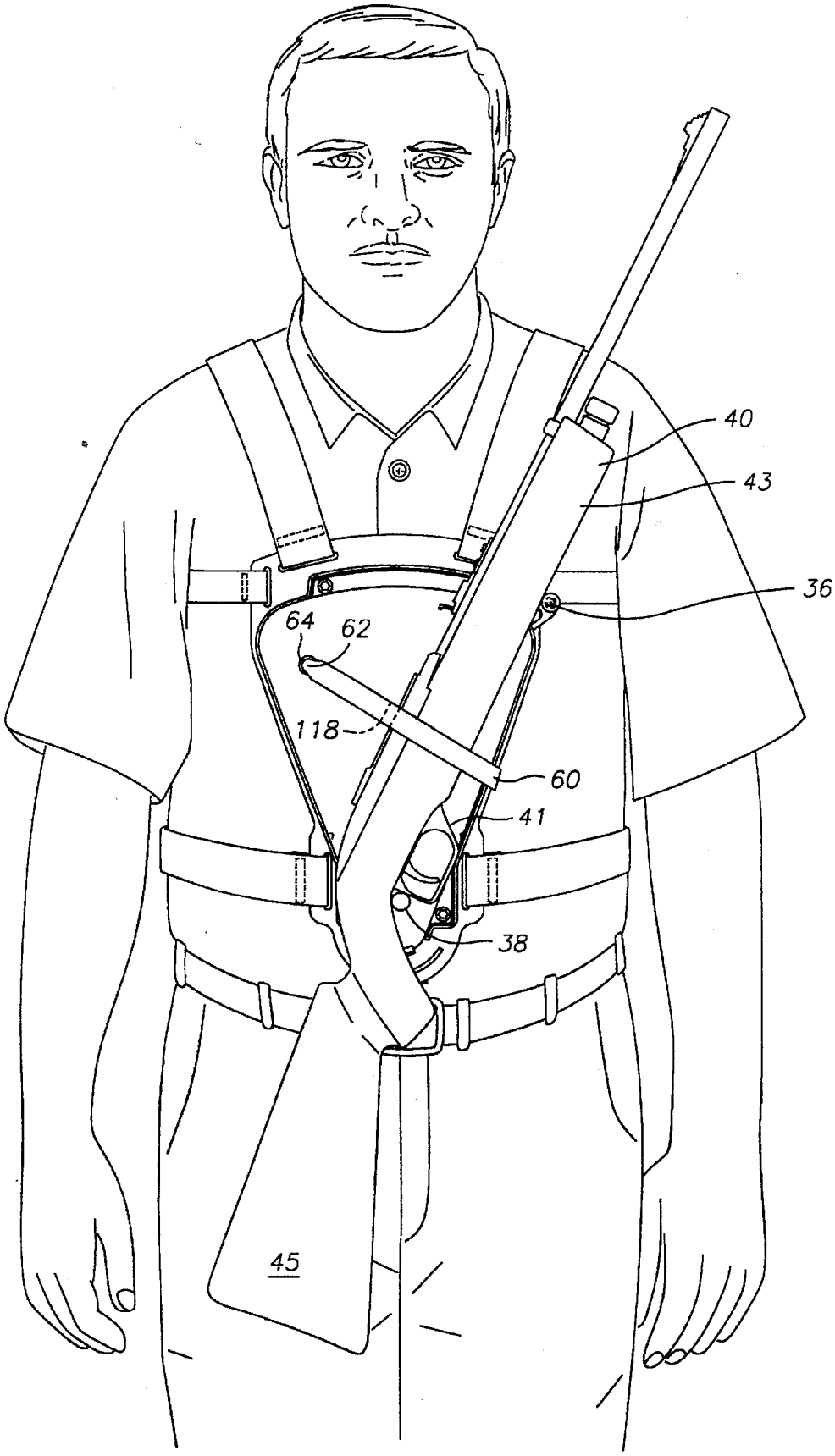
FIG. 4 depicts the user wearing the firearm support of FIG. 1 and illustrating its use in conjunction with a firearm supported thereat.

Securing means, namely a fastening strap 60, for securing the firearm 40 to the base assembly 10 (rather than supporting the weight of the firearm 40 adjacent to the base assembly 10, which is the function of the support means) are also disclosed in FIG. 1. Other securing means can also comprise a hook, magnet, cord, and securing strap utilizing hook and loop fasteners of the type commonly sold under the trade name VELCRO. For the discussion of this first embodiment of the instant invention, however, a fastening strap 60 is envisioned. Said fastening strap 60 comprises two opposite ends: an inner end 60A and an outer end 60B. A plug 62, seen in FIG. 3A and in detail in FIG. 3B, is affixed to the outer end 60B of the fastening strap 60. Said plug 62 detachably mates with a socket 64, such that the fastening strap 60 may be snugly cinched about the firearm 40, pressing and holding said firearm 40 upon the support means and against the base assembly 10, securing the firearm 40 firmly thereat as seen in FIG. 4. This snug cinching of the fastening strap 60 allows a user 32 of the instant invention who is supporting a firearm 40 to engage in various physical activities without worries of the firearm 40 shifting or coming loose. A fastening strap catch 118 is secured to the fastening strap 60 and protrudes downward from said fastening strap 60 to buttress the edge of the firearm 40 as seen in FIG. 4, adding further stability thereto. In addition, the configuration of the first support pin 36 and the second support pin 38 is such that the center of gravity of the firearm 40 is optimally located at the user's 32 mid-section, thus allowing the user 32 to move about comfortably.

The length and vertical position of the fastening strap 60 are adjustable, thus further adding to the adjustability of the instant invention, in an attempt to accommodate firearms of all makes, models, styles and sizes. A fastening strap adjustment mechanism 66 for adjusting the length and position of the fastening strap 60 is contained between the main plate 14 and intermediate plate 16 and comprises a pair of plates 68, between which a portion of the fastening strap 60 is sandwiched. By decreasing the pressure between the plates 68 by loosening a pair of end bolts 76 which draw said plates 68 together, the fastening strap 60 may be pulled through said plates 68, thus increasing its length in the event this becomes necessary due to a desire to secure a firearm 40 of larger than normal girth to the base assembly 10. In the event a smaller firearm 40 is to be utilized, excess length of the fastening strap 60 may be inserted between the plates 68 and stored in the cavity located between the main plate 14 and intermediate plate 16. The vertical height of the fastening strap 60 may also be adjusted by loosening a center bolt 78 of the fastening strap adjustment mechanism 66 and sliding the entire mechanism 66, and hence the fastening strap 60, up or down.

The position of the socket 64 which detachably accepts the plug 62 of the fastening strap 60 is adjustable, as indicated by the direction of arrow 70 in FIG. 1. The length of socket aperture 72, bored into the intermediate plate 16, dictates the permissible amount of travel position of the socket 64. It should be observed that while the length of said socket aperture 72 appears minimal in FIG. 1, it may nevertheless extend across the entire width of the base assembly 10. A socket aperture 72 of corresponding size and shape may also be present upon the face plate 18, or a single hole can be punched into said face plate 18 to correspond to the final adjusted position of the socket 64, as seen in FIG. 3A. To better understand the adjustability of the socket 64, the details of a release mechanism cartridge 74 which is contained between the main plate 14 and the intermediate plate 16 of the base assembly 10 must first be discussed.

Figure 2A:
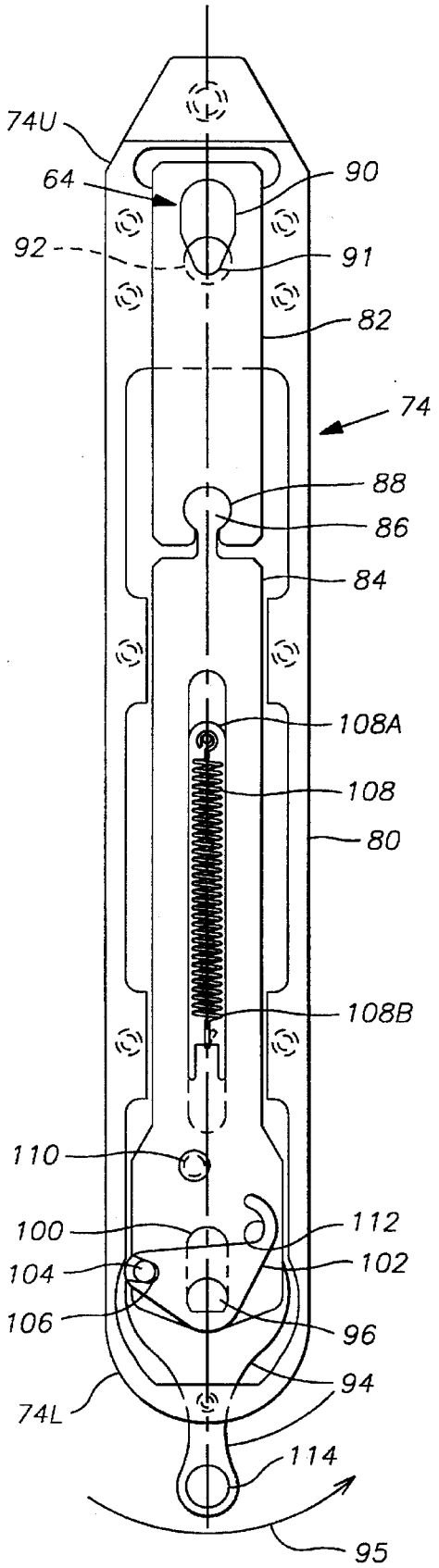
FIG. 2A is a detailed plan view of a release mechanism cartridge of the device of FIG. 1 shown in a locked position.
Figure 2B:
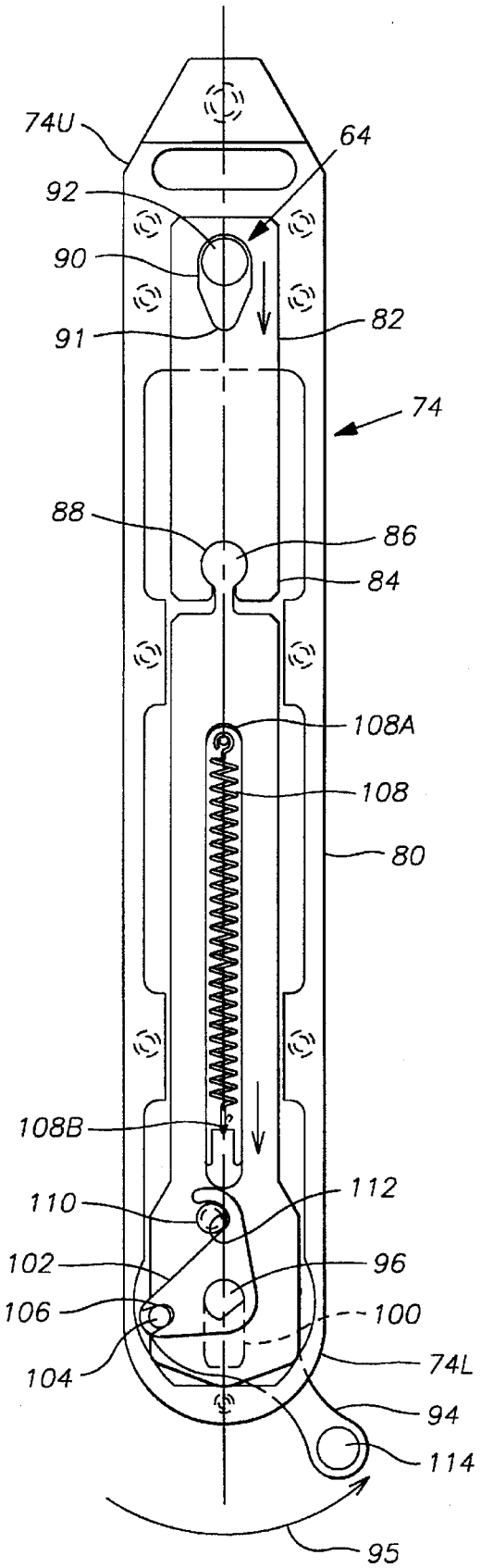
FIG. 2B is a detailed plan view of the release mechanism cartridge shown in an open position.

The release mechanism cartridge 74, having an upper end 74U and a lower end 74L, can be seen in more detail by reference to FIGS. 2A and 2B. Located in the cavity between the main plate 14 and intermediate plate 16 as was seen in FIG. 1, the release mechanism cartridge 74 allows the position of the socket 64 to be varied by pivoting the entire release mechanism cartridge 74 about a pivot point 75. The release mechanism cartridge 74 further comprises a rigid base 80 which accepts an upper slide component 82 and a lower slide component 84. A key 86 protrudes from the lower slide component 84 and mates with a key-way 88 of the upper slide component 82. Accordingly, movement of the lower slide component 84 will induce concurrent, equivalent directional movement of the upper slide component 82.

The socket 64 of the release mechanism cartridge 74 comprises a first opening 90 having a tapered portion 91, which is located on the upper slide component 82, and a second opening 92 which is located upon the rigid base 80 of the release mechanism cartridge 74, directly under said first opening 90. In a locked position, such as that depicted in FIG. 2A, the tapered portion 91 of the first opening 90 moves directly above the second opening 92, such that the plug 62 depicted in FIGS. 3A and 3B is pinched and locked therein.

A trigger 94 is positioned between the rigid base 80 and lower slide component 84 at the lower end 74L of the release mechanism cartridge 74. A D-shaft 96 protrudes upward from the trigger 94 and penetrates a corresponding shaftway 100 in both the lower slide component 84 and a trigger carriage 102 which is situated on top of said lower slide component 84. A slide pin 104 projects upward from the lower slide component 84 and is received by a trigger carriage indent 106. A spring 108 has opposite spring ends 108A and 108B. Spring end 108A is affixed to the rigid base 80 and spring end 108B is affixed to the lower slide component 108B, whereby said spring 108 biases the lower slide component 80 upward, resistant to the movement of the trigger 94 in the direction of arrows 95 indicated in FIGS. 2A and 2B. By applying sufficient force to overcome the resistance of the spring 108 and urging the trigger 94 in the direction indicated by the arrow 95 of FIG. 2A, the slide pin 104 contained within the trigger carriage indent 106 is forced downward, thus drawing the entire lower slide component 84 and hence upper slide component 82 downward. As the upper slide component 82 is drawn downward, the tapered portion 91 of the first opening 90 travels beyond the second opening 92 which is located upon the rigid base 80 of the release mechanism cartridge 74, entering an open position as seen in FIG. 2B. As a result, the plug 62 which was pinched thereat while the release mechanism cartridge 74 was in a locked position is released from the socket 64.

The initial travel of the trigger 94 to cause the release of the plug 62 from the socket 64 is accomplished silently, due to the smooth interaction of the trigger carriage 102 with the slide pin 104. This partial travel of the trigger 94 only temporarily causes the release mechanism cartridge 74 to enter the open position of FIG. 2B from the locked position of FIG. 2A. If the manual force applied to the trigger 94 is discontinued, the spring 108 urges the release mechanism cartridge 74 back to the closed position illustrated in FIG. 2A. If the trigger 94 is urged the complete travel distance in the direction of the arrows 95 of FIGS. 2A and 2B, a locking pin 110 which is located upon the lower slide component 84 will eventually engage a pawl 112 of the trigger carriage 102, securing the device in the open position as seen in FIG. 2B. A safety mechanism 116, as illustrated in FIG. 1, allows the trigger 94 to be locked, preventing unwanted or accidental actuation of the trigger 94 which might inadvertently release the plug 62 from the socket 64 and allow the firearm 40 to disengage the base assembly 10.

A trigger adjustment screw 114, located upon the trigger 94, permits the initial position of the trigger 94 to be varied to the left or right so as to accommodate the preferences of individual users 32. A user 32 having smaller hands, for instance, might choose to position the trigger 94 off-center to the left or right in order to make it more accessible and within the user's 32 reach. Further customization of the instant invention is possible in that the configuration of the base assembly 10 and release mechanism cartridge 74 permit the device to be easily converted from left to right hand use and vice-versa.

Operation and use of the instant invention is quite simple. The base assembly 10 is secured to the user 32 by the user donning the harness 12, as seen in FIG. 3A. The strap connectors 34 are employed to ensure that the shoulder straps 30, underarm straps 28 and waist straps 22 fit snugly about the body of the user 32. As seen in FIG. 4, a firearm 40 having a trigger guard 41, barrel area 43 and butt 45 is placed upon the base assembly 10 by resting the rear of the trigger guard 41 upon the second support pin 38, and resting the barrel area 43 upon the first support pin 36. For certain types of firearms 40 having an elongated trigger guard 41 which is not capable of resting securely upon the second support pin 38 (such as lever-action rifles and shotguns), said second support pin 38 may be inserted through the trigger guard 41. Once properly supported upon the base assembly 10 by the support pins 36 and 38, the firearm 40 is then detachably secured thereto by cinching the fastening strap 60 about the firearm 40, and inserting the plug 62 which is secured to the outer end 60B of the fastening strap 60 into the socket 64. The user 32 is then capable of moving about freely, with the secured firearm 40 forming an almost integral part of the user's 32 body.

Referring to FIGS. 3A and 4, it can be seen that upon determination by the user 32 that he wishes to ready the firearm 40 for use, the trigger 94 is actuated which releases the plug 62 from the socket 64, freeing the fastening strap 60 from its enclosure about the firearm 40. The user 32 then pushes the firearm 40 away from the base assembly 10 off of the support pins 36 and 38, and can instantly aim and/or discharge the firearm 40 if so desired.

What is claimed is:

1. A firearm support for supporting a firearm adjacent to a user's chest, comprising:

a) a base assembly;

b) a harness, secured to said base assembly, for securing said base assembly adjacent to the chest of the user;

c) support means, rigidly fixed to said base assembly, for supporting the firearm adjacent to and against the base assembly by allowing the firearm to rest upon said support means, said support means further having a first support pin and a second support pin, protruding outward from the base assembly, thus permitting any configuration firearm to rest upon and be supported by said support pins; and d) securing means, located upon said base assembly, for detachably securing and holding the firearm adjacent to and against the base assembly upon the support means.

2. The firearm support of claim 1, wherein the first support pin is at higher orientation upon the base assembly than the second support pin, such that a firearm having a barrel area and a trigger guard may be supported by resting the barrel area of the firearm upon said first support pin, and resting the trigger guard of the firearm upon the second support pin, causing the center of gravity of the firearm to be positioned midway between the first support pin and second support pin, and hence at center of user's chest.

3. The firearm support of claim 1, wherein the securing means for detachably holding the firearm adjacent to the base assembly comprise a fastening strap having an inner end and an outer end, the inner end rigidly secured to the base assembly on one side of the firearm, the outer end detachably secured to the base assembly on the opposite side of the supported firearm such that said fastening strap may be looped over the firearm thus firmly cinching and holding the firearm adjacent to the base assembly in its supported position upon the support pins.

4. The firearm support of claim 3, wherein the fastening strap is adjustable in length so that it may be sized to accommodate and secure firearms of various sizes to the base assembly.

5. The firearm support of claim 4, further comprising a plug affixed to the outer end of the fastening strap and a socket located upon the base assembly which detachably receives said plug.

6. The firearm support of claim 5 further comprising a trigger, the actuation of said trigger resulting in the disengagement of the plug from the socket.

7. The firearm support of claim 6, further comprising an elongated slide member having an outer end and having the first support pin secured to said outer end, an adjustment disc, the elongated slide member extending through the adjustment disc such that the position of the first support pin can be varied by rotating the adjustment disc and elongated slide member protruding therefrom.

8. The firearm support of claim 7, further comprising a release mechanism cartridge having the socket located thereon, said release mechanism cartridge pivotable about a pivot point, whereby the position of the socket may be varied by pivoting the release mechanism cartridge about the pivot point.

9. A firearm support for supporting a firearm adjacent to a user's chest, comprising:

a) a base assembly;

b) a harness, secured to said base assembly, for securing the base assembly adjacent to the chest of the user;

c) a plurality of support pins, located upon and extending outward from said base assembly, which permit any configuration firearm to rest upon and be supported by said support pins; and d) a fastening strap, having an inner end and an outer end, the inner end rigidly secured to the base assembly on one side of the firearm, the outer end detachably secured to the base assembly on the opposite side of the supported firearm, such that said fastening strap may be looped over the firearm, firmly cinching and holding the firearm adjacent to the base assembly in its supported position upon the support pins.

10. The firearm support of claim 9, further comprising a plug affixed to the outer end of the fastening strap, and a socket located upon the base assembly which detachably receives said plug.

11. The firearm support of claim 10 further comprising a trigger, the actuation of said trigger resulting in the disengagement of the plug from the socket.

12. The firearm support of claim 11, wherein the fastening strap is adjustable in length so that it may be sized to accommodate and secure firearms of various sizes to the base assembly.

13. The firearm support of claim 12, further comprising a release mechanism cartridge having the socket located thereon, said release mechanism cartridge pivotable about a pivot point, whereby the position of the socket may be varied by pivoting the release mechanism cartridge about the pivot point.

14. A firearm support for supporting a firearm adjacent to a user's chest, comprising:

a) a base assembly;

b) a harness, secured to said base assembly, for securing the base assembly adjacent to the chest of the user;

c) a plurality of support pins, located upon and extending outward from said base assembly, which permit any configuration firearm to rest upon and be supported by said support pins, the position of said support pins adjustable; and d) a fastening strap, the position and length of said fastening straps adjustable, having an inner end and an outer end, the inner end rigidly secured to the base assembly on one side of the firearm, the outer end detachably secured to the base assembly on the opposite side of the supported firearm, such that said fastening strap may be looped over the firearm, firmly cinching and holding the firearm adjacent to the base assembly in its supported position upon the support pins.

15. The firearm support of claim 14 further comprising an adjustable position trigger, the actuation of said trigger resulting in the disengagement of the fastening strap from the base assembly, thus releasing the weapon from its supported position on the support pins thereon.

* * * * *